US005574331A

United States Patent [19]

An et al.

[11] Patent Number: 5,574,331

[45] Date of Patent: Nov. 12, 1996

[54] IN-LINE ELECTRON GUN FOR A COLOR PICTURE TUBE

[75] Inventors: Sung-Gi An; Hyun C. Kim; Sung-Ho Cho; Hee S. Lee; Won-Hyun Kim; Hee-Won Yun, all of Seoul, Rep. of Korea

[73] Assignee: Goldstar Co., Ltd., Seoul, Rep. of Korea

[21] Appl. No.: 375,872

[22] Filed: Jan. 20, 1995

[30] Foreign Application Priority Data

Jan. 22, 1994 [KR] Rep. of Korea ..... 1994-1175

[51] Int. Cl.[6] ..... H01J 29/50

[52] U.S. Cl. ..... 313/414; 315/15; 315/16

[58] Field of Search ..... 313/412, 414; 315/14, 15, 16, 382

[56] References Cited

U.S. PATENT DOCUMENTS

| | | | |
|---|---|---|---|
| 2,888,606 | 5/1959 | Beam | 315/16 |
| 4,253,041 | 2/1981 | Blacker et al. | 313/414 |
| 4,473,775 | 9/1984 | Hosokoshi et al. | 313/414 |
| 4,591,760 | 5/1986 | Kimura | 315/16 |
| 4,704,565 | 11/1987 | Blacker, Jr. et al. | 313/412 |
| 4,786,845 | 11/1988 | Kato et al. | 315/15 |
| 4,853,601 | 8/1989 | Odenthal | 313/412 |
| 4,940,917 | 7/1990 | Stil | 313/412 |
| 4,967,120 | 10/1990 | Katsuma et al. | 315/15 |
| 5,034,654 | 7/1991 | Leyland et al. | 313/414 |
| 5,061,881 | 10/1991 | Suzuki et al. | 315/15 |

*Primary Examiner*—Sandra L. O'Shea
*Assistant Examiner*—Matthew J. Esserman
*Attorney, Agent, or Firm*—Spencer & Frank

[57] ABSTRACT

An in-line electron gun for a color picture tube has an accelerating electrode portion separated into two or three electrodes in a triode, in which a voltage supplied to respective electrodes is varied and an asymmetrical hole is formed in at least one among the electrodes to form an additional asymmetric lens, thereby preventing degradation of a focus characteristic caused by an abrupt increase of a diverging angle of electron beam in a high current region, degradation in the vertical electron beam due to an influence of a magnetic field of a deflection yoke, change of focusing force induced by voltage variation of a first accelerating/focusing electrode, and degradation of the electron beam owing to collision/repulsion among electrons in the electron beam.

8 Claims, 5 Drawing Sheets

IN-LINE ELECTRON GUN FOR A COLOR PICTURE TUBE

FIELD OF THE INVENTION

The present invention relates to an in-line electron gun for a color picture tube, and more particularly to an electron gun for a color picture tube, wherein an accelerating electrode in a triode of an electron gun is separately formed for solving degradation of a focus characteristic caused by an abruptly increased diverging angle of electron beam in a high current region.

BACKGROUND OF THE INVENTION

Generally, respective electrodes (e.g., a control electrode, an accelerating electrode, and a focus electrode) of an in-line electron gun are placed to be apart from one another by a predetermined distance to be perpendicular to a path through which electron beam passes, so that the electron beam originated from a cathode is controlled in regular intensity and shaped to reach a screen.

As illustrated in FIG. 1, a general color picture tube having such an electron gun includes cathodes 3 separated from one another for emitting electron beams 13, and a control electrode 4 for controlling the electron beams 13 from the cathodes 3. An accelerating electrode 5 directs to accelerate thermoelectrons gathered around the surface of the cathodes 3 while maintaining a regular distance from the control electrode, and first and second accelerating/focusing electrodes 6 and 7 focus the electron beams 13 having passed through the accelerating electrode 5 onto a phosphor screen 11. In addition to these, the color picture tube has a shield cup 8 attached with bulb spacers 9 placed on the upper portion of the first and second accelerating/focusing electrodes 6 and 7, heaters 2 for generating heat by means of a power from stem pins 1, a mask 10, a deflection yoke 12, and a neck 14.

The operation of the color picture tube constructed as above will be briefly described.

Once the heater 2 installed within the cathode 3 generates heat by receiving the power via the stem pin 1, the cathode 3 emits electrons, and the control electrode 4 controls the path of the electron beam 13 produced by gathering the electrons. The controlled electron beam 13 is accelerated by the accelerating electrode 5, focused after passing through the first and second accelerating/focusing electrodes 6 and 7 which form a main lens, and then passes through the mask 10 installed to the inner surface of the phosphor screen 11 to collide with phosphors on the phosphor screen 11. The collision of the electron beam radiates light to allow the color picture tube to display a picture.

In the general color picture tube, the structure of the triode of the conventional in-line electron gun is illustrated in FIG. 2.

Here, the accelerating electrode 5 has by an embedded regressive slot 15 therein which is wider in the horizontal direction than in the direction perpendicular to the horizontal direction with respect to holes.

FIG. 3 is a simulation modeling of electric field distribution and emission of the electron beam in the triode shown in FIG. 2. The electron beam 13 emitted from the cathode 3 presents a crossover phenomenon that the electron beam 13 attracts onto a certain point to be reradiated by the influence of an electrostatic lens formed between the accelerating electrode 5 and control electrode 4. It is considered that an equipotential line of the accelerating electrode 5 results in the crossover phenomenon by focusing to attract the emitted electron beam 13 after passing through the control electrode 4.

After focusing a crossover point 41 as described above, the electron beam 13 is focused and diverged by a lens formed by the accelerating electrode 5 to advance toward the main lens.

In association with the structure, however, the regressive slot 15 in the accelerating electrode 5 thickens the accelerating electrode in horizontal direction when compared with that in the vertical direction to force the horizontal diverging angle to be wider than the vertical diverging angle of the electron beam 13, thereby forming a horizontally-elongated electron beam.

The horizontally-elongated electron beam serves to decrease the focusing of the vertical electron beam and prevent the collision and increased repulsion among the electrons in the electron beam by a magnetic field of the deflection yoke 12.

However, in the conventional in-line electron gun, since the crossover point is formed at high speed after emitting the electron beam, the divergence force of the electron beam is abruptly increased in the overall area of the high current region. Therefore, the electron beam raises spherical aberration which is caused by the different reflective index between the center and periphery in the main lens portion to induce a problem in the focus characteristic. Also, the slot for forming the horizontally-elongated electron beam is liable to produce eccentricity and deformation during the fabrication process thereof which is very demanding operation.

Furthermore, the focusing force of peripheral beam toward the central beam is changed resulting from the voltage variation of the first accelerating/focusing electrode to involve a problem in the fabricating operation as well as degrade quality characteristic.

SUMMARY OF THE INVENTION

Accordingly, it is an object of the present invention to provide an in-line electron gun for a color picture tube for separately forming an accelerating electrode in a triode of the electron gun, thereby being capable of maintaining a focus characteristic degraded by a phenomenon of an abruptly widened diverging angle of electron beam in a high current region.

It is another object of the present invention to provide an in-line electron gun for a color picture tube for preventing degradation of vertical electron beam resulting from the influence of a magnetic field of a deflection yoke.

It is still another object of the present invention to provide an in-line electron gun for a color picture tube for preventing degradation of electron beam originated from collision/repulsion among electrons in the electron beam.

To achieve the above and other objects of the present invention, there is provided an in-line electron gun for a color picture tube including a cathode, a control electrode, an accelerating electrode portion having at least three separately-formed plate electrodes spaced apart from one another by a predetermined distance, and a first accelerating/focusing electrode. Here, the first and third electrodes in the separated accelerating electrode portion are supplied with the potential of the accelerating electrode, and the second electrode is supplied with a potential lower than that of the accelerating electrode.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Figure 4:
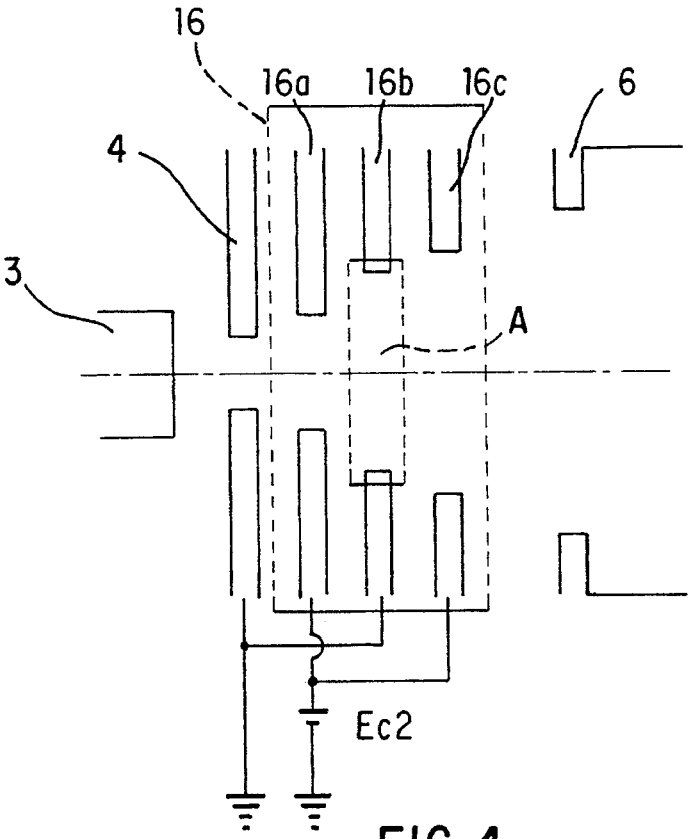
FIG. 4 is a front view showing a first embodiment of a triode in an in-line electron gun according to the present invention.

Referring to FIG. 4, a triode of an in-line electron gun according to the present invention includes a cathode 3 for emitting electrons, a control electrode 4 for controlling an electron beam from the cathode 3, an accelerating electrode portion 16 for accelerating the electron beam via the control electrode 4, and a first accelerating/focusing electrode 6 for accelerating and focusing the electron beam accelerated via the accelerating electrode portion 16.

The operation and effect according thereto of the electron gun constructed as above will be described with reference to FIGS. 5, 10 and 11.

To being with, the cathode 3 emits the electrons upon generating heat by a heater within the cathode.

The control electrode 4 controls the path of the electron beam from the cathode 3, and then the electron beam is accelerated by the accelerating electrode portion 16.

Figure 2:
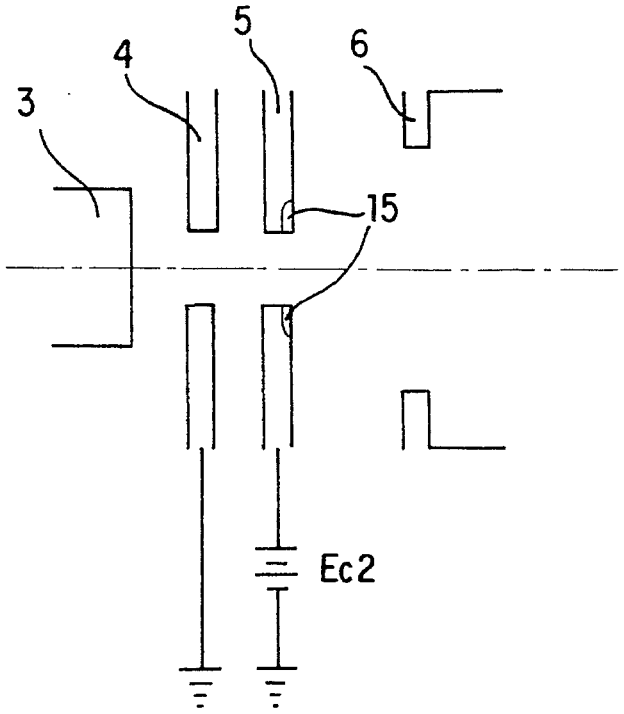
FIG. 2 (PRIOR ART)
FIG. 2 is a front view showing the triode in the conventional in-line electron gun.

As shown in FIG. 4, the accelerating electrode portion 16 is formed of plate electrodes 16*a*, 16*b* and 16*c* separated into three parts, in which the first electrode 16*a* in the separated accelerating electrode portion 16 is supplied with a voltage identical to a voltage Ec2 supplied to the conventional accelerating electrode (the reference numeral 5 in FIG. 2), and the second electrode 16*b* is supplied with a ground voltage supplied to the control electrode 4.

At the same time, the separated third electrode 16*c* is supplied with the voltage Ec2 identical to that supplied to the first electrode 16*a*.

Figure 3:
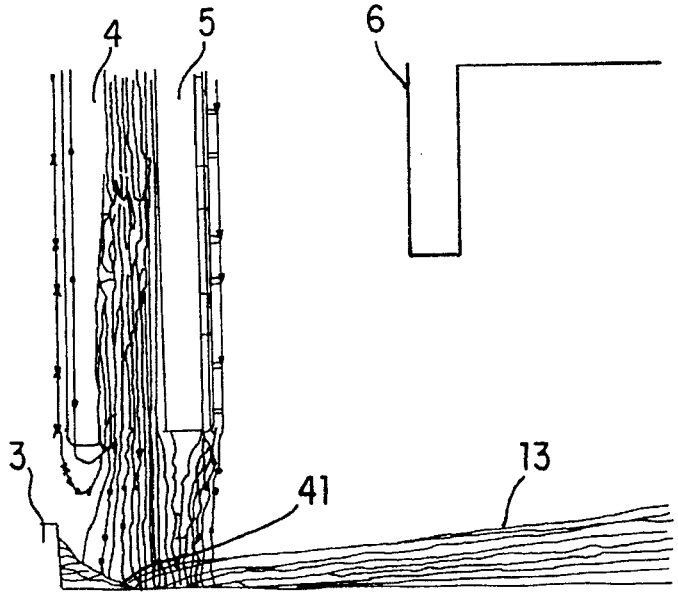
FIG. 3 (PRIOR ART)
FIG. 3 is a view for illustrating the electric field distribution and emission of the electron beam in the triode shown in FIG. 2.
Figure 5:
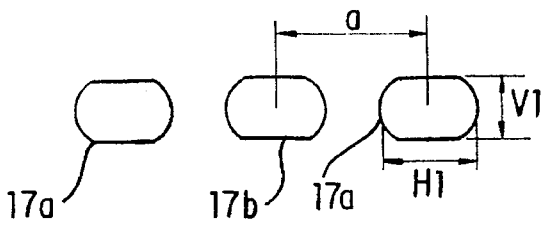
FIG. 5 is a detailed view showing the A portion of FIG. 4.

In order to provide two crossover points (the reference numeral 41 in FIG. 3) to the electron beam from the cathode 3, i.e., to form an astigmatism lens that has a different divergence lens of the electron beam in the horizontal direction and vertical direction, holes 17*a* and 17*b* are formed in the second electrode 16*b* of the accelerating electrode portion 16 while differing the horizontal width $H_1$ and the vertical width $V_1$, as shown in FIG. 5.

Additionally, a distance a from the center of the central hole 17*b* to the center of the side hole 17*a* is provided differently from that between the control electrode 4 and the first accelerating/focusing electrode 6 to compensate for the varied focusing force (hereinafter referred to as "STC") of the peripheral beam toward the central beam initiated by a refraction lens between the first accelerating/focusing electrode 6 and second accelerating/focusing electrode (not shown) which are the main lens formation electrodes.

Figure 10:
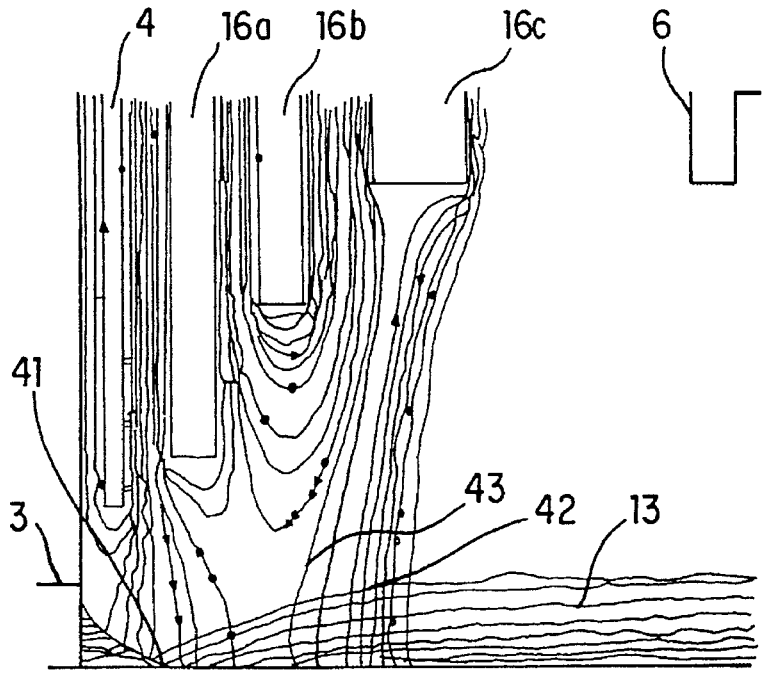
FIG. 10 is a view for illustrating the electric field distribution and emission of the electron beam in the triode of the in-line electron gun according to the present invention.

FIG. 10 is a view simulating the emission and electric field distribution of the electron beam in the electron gun formed as above. In connection with the electron beam 13 from the cathode 3 as can be represented in the drawing, an equipotential line of the first electrode 16*a* in the accelerating electrode portion 16 focuses to attract the electron beam 13 radiated after passing through the control electrode 4, thereby forming the crossover point 41.

Here, the crossover point 41 further attracts toward a screen by a divergence lens 42 of the first electrode 16*a* in the accelerating electrode portion 16, and then functions to decrease the diverging angle of the electron beam 13 by the operation of a converging lens 43 of the second and third electrodes 16*b* and 16*c*.

In the above structure, the divergence lens 42 of the first electrode 16*a* in the accelerating electrode portion 16 decreases the astigmatism which significantly affects the focus characteristic, and forms converging/diverging lens together with the second and third electrodes 16*b* and 16*c*. Thus, as shown in FIG. 11, the change of the diverging angle of the electron beam resulting from the varied electron beam current $I_K$ can be decreased in the color picture tube that requires the electron beam of high current to thereby afford excellent focus characteristic in overall current range.

Figure 11:
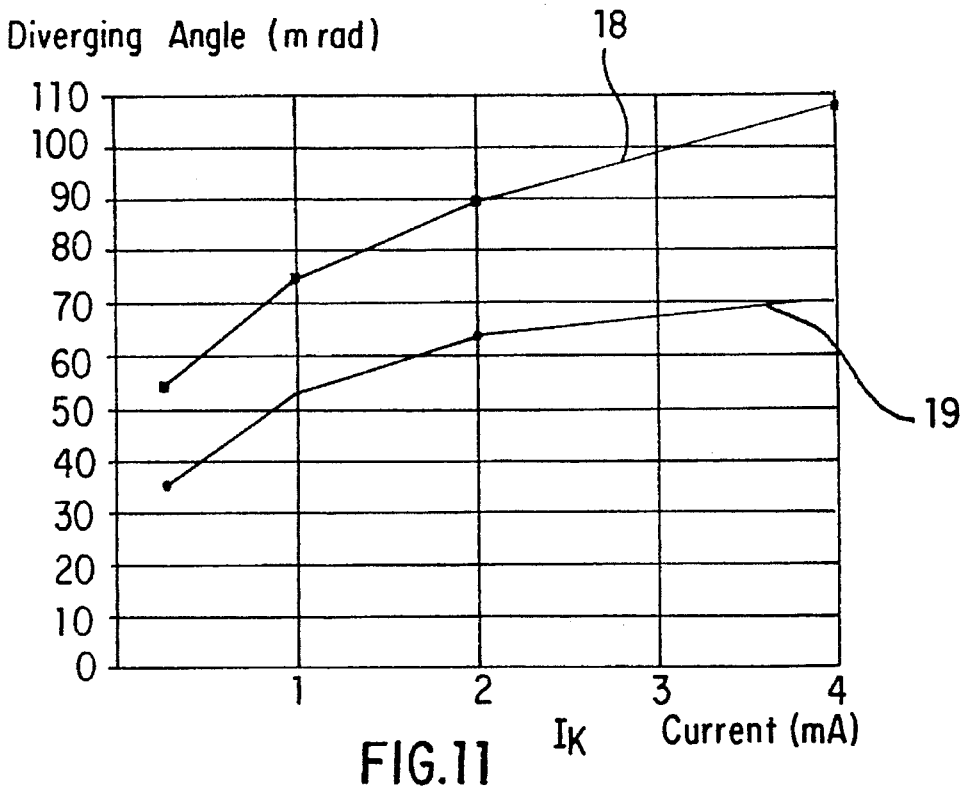
FIG. 11 is a view plotting the changes of the diverging angles of the electron beam in view of current variations in the triode of the conventional electron gun and that according to the present invention.

As one instance, when the electron beam current $I_K$ is increased from 2 mA to 4 mA as shown in FIG. 11, the changing rate of a graph inclination 19 according to the present invention is remarkably decreased over that of a conventional graph inclination 18.

Figure 1:
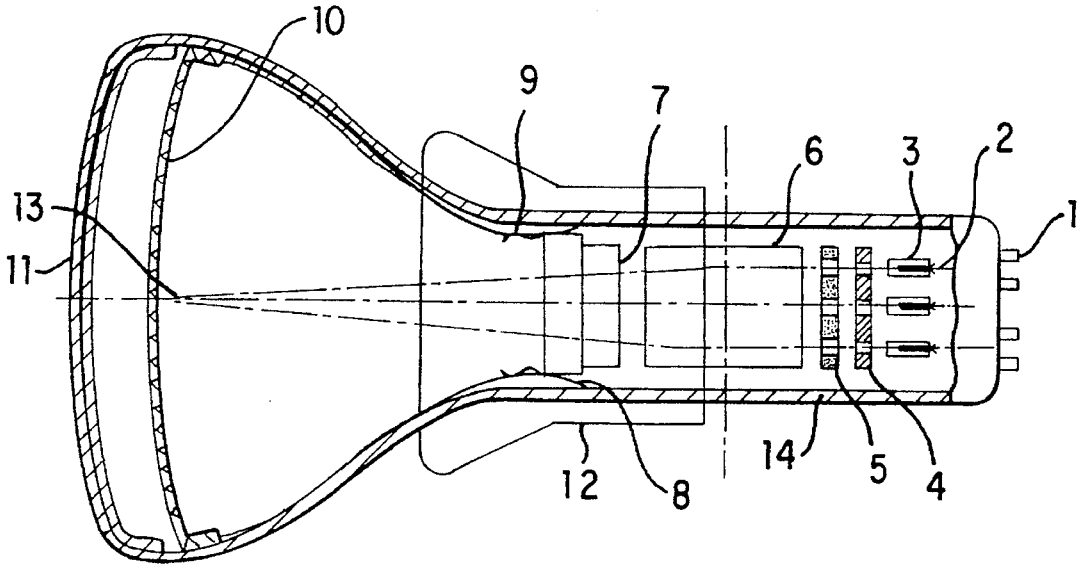
FIG. 1 (PRIOR ART)
FIG. 1 is a view showing the construction of a general color picture tube.

Furthermore, in order to prevent the degradation of the electron beam caused by a phenomenon that reinforces the focusing strength of the electron beam in the vertical direction due to the influence of the magnetic field of the deflection yoke (the reference numeral 12 in FIG. 1), the electron beam passing through the main lens is formed to be smaller in the vertical direction than that in the horizontal direction. For this purpose, in the holes 17*a* and 17*b* of the second electrode 16*b* in the accelerating electrode portion 16 shown in FIG. 5, the horizontal diameter H1 is formed larger than the vertical diameter V1 to form a horizontally-elongated electron beam having a different diverging angle in the horizontal and vertical directions.

Also, to compensate for the change of the focusing force induced by the voltage variation of the first accelerating/ focusing electrode 6, a distance a between the centers of the central hole 17*b* and of the side hole 17*a* of the second electrode 16*b* in the accelerating electrode portion 16 is reduced to be shorter than the distance between the centers of the central holes and side holes of the control electrode 4 and first accelerating/focusing electrode 6, so that the refractive lens affecting the peripheral electron beam may be formed.

By forming as above, when the voltage of the first accelerating/focusing electrode 6 is raised, the refractive lens strength of the main lens is weakened. Consequently, the focusing strength of the peripheral electron beam toward the central beam is not enough, but the refractive lens between the second electrode 16*b* and the first accelerating/focusing electrode 6 affects to focus the peripheral electron beam toward the central beam to compensate for the weakened focusing strength.

On the contrary, if the voltage of the first accelerating/focusing electrode 6 is lowered, the refractive lens strength of the main lens is reinforced as such to intensify the focusing strength of the peripheral electron beam toward the central beam while compensating for the excessive focusing strength of the peripheral electron beam toward the central beam by the influence of the refractive lens between the second electrode 16*b* and first accelerating/focusing electrode 6.

Figure 6:
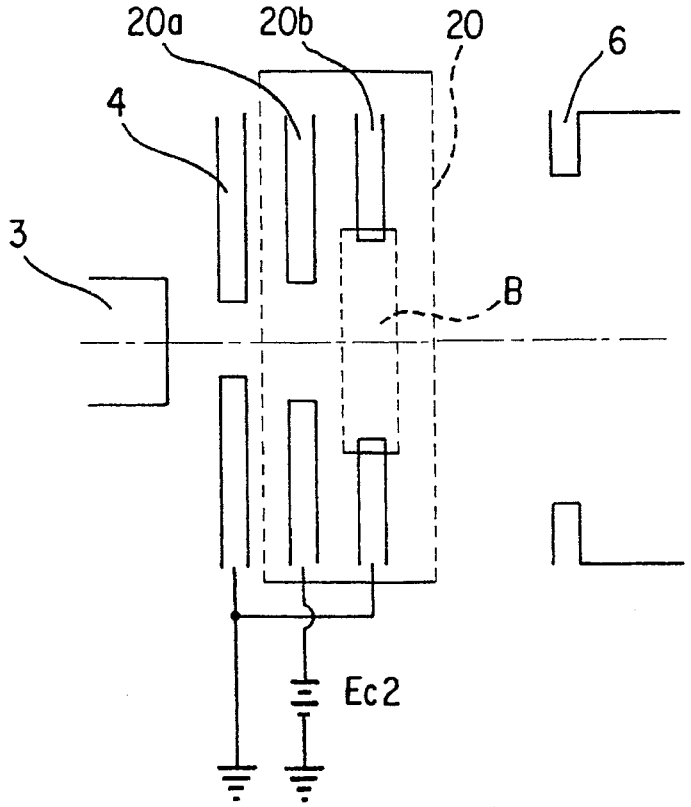
FIG. 6 is a front view showing a second embodiment of the triode in the in-line electron gun according to the present invention.

FIG. 6 shows another embodiment of the in-line electron gun for the color picture tube according to the present invention, in which an accelerating electrode portion 20 is formed of two separated plate electrodes 20*a* and 20*b*. The separated first electrode 20*a* is supplied with the voltage identical to the voltage Ec2 applied to the conventional accelerating electrode (the reference numeral 5 of FIG. 1), and the second electrode 20*b* is supplied with the ground voltage.

Figure 7:
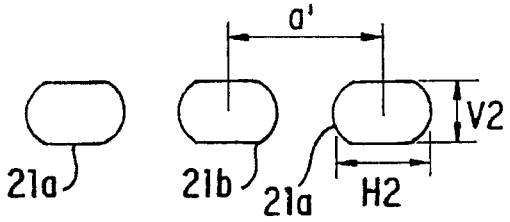
FIG. 7 is a detailed view showing the B portion of FIG. 6.

As shown in FIG. 7, holes 21*a* and 21*b* of the second electrode 20*b* in the accelerating electrode portion 20 are formed to have a horizontal width H2 wider than a vertical width V2, and a distance a' between the centers of the side hole 21*a* and central hole 21*b* differs from that of the control electrode 4 and first accelerating/focusing electrode 6.

By this construction, the potential difference between the second electrode 20*b* and first accelerating/focusing electrode 6 are maximized to minimize the diverging angle of the electron beam 13.

Moreover, the holes 21*a* and 21*b* of the second electrode 20*b* are shaped to have the horizontal width H2 wider than the vertical width V2, and the distance a' between the centers of the side hole 21*a* and central hole 21*b* differs from that of the control electrode 4 and first accelerating/focusing electrode 6, thereby compensating for the change of the focusing strength STC resulting from the influence of the magnetic field of the deflection yoke 12 and voltage variation of the first accelerating/focusing electrode 6, as plotted in FIG. 11.

By separating the accelerating electrode portion 20 into two plate electrodes 20*a* and 20*b*, and by maximizing the potential difference as described above, the in-line electron gun can be easily adopted to a large-sized color picture tube with a 25-inch screen and higher.

Figure 8:
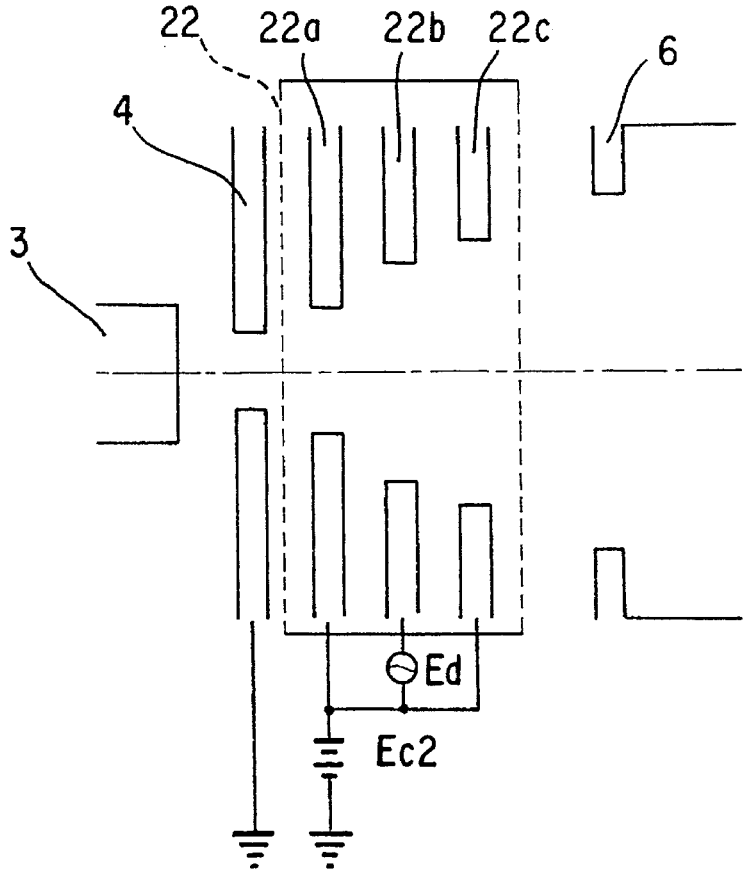
FIG. 8 is a front view showing a third embodiment of the triode in the in-line electron gun according to the present invention.
Figure 9:
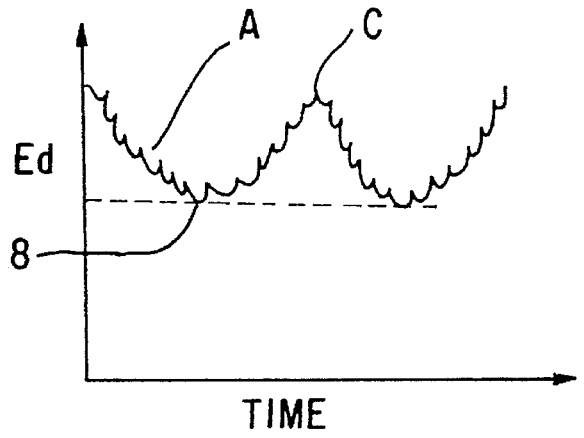
FIG. 9 shows a waveform of the voltage supplied to the second electrode of FIG. 8.

FIG. 8 shows a still another embodiment of the electron gun according to the present invention, in which an accelerating electrode 22 is separated into three plate electrodes 22*a*, 22*b* and 22*c*, and the separately-formed second electrode 22*b* is supplied with a dynamic voltage as shown in FIG. 9.

At this time, the dynamic voltage is varied in accordance with the variation of deflection current of the deflection yoke (the reference numeral 12 of FIG. 1), and at least one hole of the electrodes 22*a*, 22*b* and 22*c* is asymmetrically formed to incite diverging difference of the electron beam in the vertical and horizontal directions, so that the focus characteristic in the periphery of the screen is improved.

In other words, if the electron beam 13 deflects toward the periphery of the screen, the voltage supplied to the second electrode 22*b* has the minimum value B in the dynamic voltage of FIG. 9, and the potential difference between the first & third electrodes 22*a* & 22*c* and second electrode 22*b* is maximized to magnify the difference of the diverging force of the electron beam in the horizontal and vertical directions.

As the influence of the magnified horizontal and vertical diverging difference which subjects maximized force upon the magnetic field of the deflection yoke 12 is prevented, the focus characteristic on the periphery of the screen is improved.

Contrarily, if the electron beam 13 is placed on the center of the screen, the dynamic voltage supplied to the second electrode 22*b* has the maximum value C and is in the ratio of 0 to 90% of the potentional of the accelerating electrode portion shown in FIG. 9.

When the dynamic voltage supplied to the second electrode 22*b* has the maximum value C, the potential difference between the first & third electrode 22*a* & 22*c* and second electrode 22*b* is minimized to minimize the diverging difference of the electron beam in the horizontal and vertical directions. Thus, almost circular electron beam can be obtained in the center of the screen unaffected by the deflection magnetic field to thereby improve the focus characteristic in the center of the screen.

In an in-line electron gun for a color picture tube according to the present invention as described above, an accelerating electrode of a triode in the in-line electron gun is separated into a plurality of electrodes, and a voltage supplied to the separated electrodes are varied. As a result, not only the diverging angle of electron beam but also the change of the diverging angle in high current region are decreased. Therefore, degradation of the focus characteristic resulting from an abrupt diverging angle of the electron beam in the high current region is prevented to enhance resolution.

Furthermore, in consideration of a slot formed in the accelerating electrode, the shape of a hole is changed without requiring additional processing into the accelerating electrode to facilitate the fabricating process thereof. In addition, the distance between separately-provided electrodes is differed to compensate for the change of focusing force caused by the voltage variation of a first accelerating/focusing electrode.

"In one embodiment, there is provided an in-line electron gun for a color picture tube comprising a cathode; a control electrode; an accelerating electrode portion having three separately-formed plate electrodes spaced apart from one another by a predetermined distance; and a first accelerating/focusing electrode. The first and third electrodes of the separated accelerating electrode portion are supplied with a first potential, and the second electrode thereof is supplied with a dynamic potential less than the first potential, and at least one of the separated electrodes has three asymmetrically shaped holes formed therethrough. In a specific embodiment, the horizontal dimension of the holes in the second electrode in the accelerating electrode portion is larger than the vertical dimension of the holes, and the first and third electrodes have circular holes. In another embodiment, the first and third electrodes have three holes with the horizontal dimension being larger than the vertical dimension of the holes, and the second electrode have circular holes. In still another embodiment, the first and third electrodes have three holes with the horizontal dimension being smaller than the vertical dimension of the holes, and wherein the second electrode has holes therethrough with the horizontal dimension of the holes being larger than the vertical dimension thereof."

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. An in-line electron gun for a color picture tube comprising:

a cathode;

a control electrode;

an accelerating electrode portion having three separately-formed plate electrodes spaced apart from one another by a predetermined distance; and a first accelerating/focusing electrode, wherein the first and third electrodes of said separated accelerating electrode portion are supplied with a first potential, and the second electrode thereof is supplied with a potential lower than said first potential.

2. An in-line electron gun for a color picture tube as claimed in claim 1, wherein the horizontal diameter of three holes formed in said second electrode of said accelerating electrode portion is larger than the vertical diameter of them.

3. An in-line electron gun for a color picture tube as claimed in claim 1, wherein the distance between centers of the central hole and side hole of said second electrode in said accelerating electrode portion is shorter than the distance between centers of the central holes and sides holes of said control electrode and first accelerating/focusing electrode.

4. An in-line electron gun for a color picture tube comprising:

a cathode;

a control electrode;

an accelerating electrode portion having three separately-formed plate electrodes spaced apart from one another by a predetermined distance; and a first accelerating/focusing electrode, wherein the first and third electrodes of said separated accelerating electrode portion are supplied with a first potential, and the second electrode thereof is supplied with a dynamic potential less than the first potential, and at least one of said separated electrodes has three asymmetrically shaped holes formed therethrough.

5. An in-line electron gun for a color picture tuber as claimed in claim 4, wherein the horizontal dimension of the holes in said second electrode in said accelerating electrode portion is larger than the vertical dimension of the holes, and said first and third electrodes have circular holes.

6. An in-line electron gun for a color picture tube as claimed in claim 4, wherein said first and third electrodes have three holes with the horizontal of said first and third electrodes in said accelerating electrode dimension being larger than the vertical dimension of the holes, and said second electrode have circular holes.

7. An in-line electron gun for a color picture tube as claimed in claim 4, wherein said first and third electrodes have three holes with the horizontal of said first and third electrodes in said accelerating electrode dimension being smaller than the vertical dimension of the holes, and wherein said second electrode has holes therethrough with the horizontal dimension of the holes being larger than the vertical dimension thereof.

8. An in-line electron gun for a color picture tube as claimed in claim 4, wherein the dynamic voltage is 0 to 90% of the first potential.

* * * * *